US012595542B2

(12) United States Patent
Ishii et al.

(10) Patent No.: US 12,595,542 B2
(45) Date of Patent: Apr. 7, 2026

(54) FLUX AND PRODUCTION METHOD OF STEEL PRODUCT WITH HOT-DIP ZN—AL—MG COATING USING SAID FLUX

(71) Applicant: NIPPON STEEL CORPORATION, Tokyo (JP)

(72) Inventors: Koutarou Ishii, Tokyo (JP); Takao Tsujimura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 433 days.

(21) Appl. No.: 17/636,920

(22) PCT Filed: May 27, 2020

(86) PCT No.: PCT/JP2020/020824
§ 371 (c)(1),
(2) Date: Feb. 21, 2022

(87) PCT Pub. No.: WO2021/038992
PCT Pub. Date: Mar. 4, 2021

(65) Prior Publication Data

US 2022/0356553 A1 Nov. 10, 2022

(30) Foreign Application Priority Data

Aug. 30, 2019 (JP) ..... 2019-158923

(51) Int. Cl.
*C23C 2/30* (2006.01)
*C22C 18/04* (2006.01)
(Continued)

(52) U.S. Cl.
CPC ..... *C23C 2/30* (2013.01); *C22C 18/04* (2013.01); *C22C 38/002* (2013.01); *C22C 38/02* (2013.01);
(Continued)

(58) Field of Classification Search
None
See application file for complete search history.

(56) References Cited

U.S. PATENT DOCUMENTS 3,943,270 A * 3/1976 Neu ..... C23C 2/30 427/310
5,292,377 A 3/1994 Izeki
(Continued)

FOREIGN PATENT DOCUMENTS

CN 110172658 A 8/2019
DE 2240046 B1 11/1973
(Continued)

*Primary Examiner* — Xiaowei Su
(74) *Attorney, Agent, or Firm* — Renner, Otto, Boisselle & Sklar, LLP

(57) ABSTRACT

Provided is a technique that can produce a hot dip Zn—Al—Mg-based alloy coated steel product with a good plating appearance, without the need for heating of a steel product prior to immersion in a hot dip plating bath. Flux (11) for hot dip Zn—Al—Mg-based alloy plating contains: $ZnCl_2$; and a low-reactive chloride which has low reactivity with respect to Mg in a plating bath and contains at least two chlorides selected from the compound group consisting of alkali metal chlorides and alkaline-earth metal chlorides, and a composition of the $ZnCl_2$ and the low-reactive chloride is adjusted so that a liquidus temperature of the flux is 450° C. or lower.

7 Claims, 3 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/02*** | (2006.01) |
| ***C23C 2/06*** | (2006.01) |

(52) U.S. Cl.
CPC ..... *C22C 38/04* (2013.01); *C22C 38/06* (2013.01); *C23C 2/022* (2022.08); *C23C 2/024* (2022.08); *C23C 2/06* (2013.01)

(56) References Cited

U.S. PATENT DOCUMENTS

| | | | |
|---|---|---|---|
| 5,853,806 | A | 12/1998 | Higuchi et al. |
| 2014/0120367 | A1 | 5/2014 | Warichet |
| 2014/0120369 | A1 | 5/2014 | Warichet |
| 2014/0120370 | A1 | 5/2014 | Warichet |

FOREIGN PATENT DOCUMENTS

| | | | |
|---|---|---|---|
| GB | 1385839 | A | 3/1975 |
| GB | 1502673 | A | 3/1978 |
| JP | 50-25440 | | 3/1975 |
| JP | 4-202751 | A | 7/1992 |
| JP | 2012-41577 | A | 3/2012 |
| JP | 2012-241277 | A | 12/2012 |
| JP | 2014-88614 | A | 5/2014 |
| JP | 2014-88616 | A | 5/2014 |
| TW | 374096 | B | 11/1999 |

* cited by examiner

FLUX AND PRODUCTION METHOD OF STEEL PRODUCT WITH HOT-DIP ZN—AL—MG COATING USING SAID FLUX

TECHNICAL FIELD

The present invention relates to flux which is a raw material of a flux bath for hot dip Zn—Al—Mg-based alloy plating, and to a method for producing a hot dip Zn—Al—Mg-based alloy coated steel product using the flux.

BACKGROUND ART

Conventionally, a hot dip galvanizing method is known as one of rust prevention methods for iron and steel materials. The hot dip galvanizing method includes a method of plating an object to be plated in a continuous line and a method of plating an object to be plated in a batch system (so-called "hot dip galvanizing method").

In the hot dip galvanizing method, for example, flux treatment is carried out on a steel product such as a steel pipe or a shape steel. Subsequently, the steel product is immersed in a hot dip galvanizing bath and then pulled up from the hot dip galvanizing bath to produce a hot dip galvanized steel product.

A hot dip Zn—Al—Mg-based alloy coated steel product is produced using a hot dip Zn—Al—Mg-based hot dip plating bath in which aluminum (Al) and magnesium (Mg) have been added to a hot dip galvanizing bath. The hot dip Zn—Al—Mg-based alloy coated steel product is in increasing demand as an alternative to a conventional hot dip galvanized steel sheet, because the hot dip Zn—Al—Mg-based alloy coated steel product maintains excellent corrosion resistance for a long time.

Generally, as methods used when producing a hot dip Zn—Al—Mg-based alloy coated steel product by the hot dip plating method, a two-bath method and a one-bath method are known.

In the two-bath method, first, a steel product is subjected to hot dip galvanizing, and then the resulting hot dip galvanized steel product is subjected to hot dip Zn—Al—Mg-based alloy plating without carrying out flux treatment. Thus, a hot dip Zn—Al—Mg-based alloy coated steel product is produced.

In the one-bath method, the step of subjecting a steel product to hot dip galvanizing is not carried out and a steel product is subjected to flux treatment and then hot dip Zn—Al—Mg-based alloy plating. Thus, a hot dip Zn—Al—Mg-based alloy coated steel product is produced.

Here, in the one-bath method, the plating appearance of the hot dip Zn—Al—Mg-based alloy coated steel product is easily deteriorated due to a reaction product or the like obtained from flux adhered to the surface of the steel product by the flux treatment and from a plating metal. If the plating appearance is deteriorated (i.e., defects such as bare spots are present), it is difficult to achieve the inherent corrosion resistance. Therefore hot dip Zn—Al—Mg-based alloy coated steel products are usually produced by the two-bath method.

Meanwhile, the one-bath method is advantageous in terms of equipment, operation time, and the like (i.e., a production cost can be reduced) as compared with the two-bath method. Therefore, a method and flux for suitably producing a hot dip Zn—Al—Mg-based alloy coated steel product by the one-bath method have been developed (see, for example, Patent Literatures 1 and 2).

In the technique disclosed in Patent Literature 1, a constituent composition of a flux aqueous solution used in flux treatment is adjusted, and a temperature of a steel material to be coated prior to immersion in a hot dip Zn—Al—Mg-based alloy plating bath is 300° C. or higher. This inhibits solidification of a reaction product of the flux component in the flux aqueous solution and the hot dip Zn—Al—Mg-based alloy plating bath component during plating. As a result, detachment of flux and the reaction product from the surface of the steel material to be coated is promoted, and thus an attempt is made to solve the problem of bare spots occurring on the surface of the hot dip Zn—Al—Mg-based alloy coated steel product.

Patent Literature 2 discloses a method in which, in a case where hot dip Zn—Al—Mg-based alloy plating is applied to a long steel product with a one-bath method, an aqueous solution of flux composition having a particular constituent composition is used to inhibit occurrence of plating defects. The flux composition used in this method contains zinc chloride, ammonium chloride, and alkali metal chloride as essential components. The alkali metal chloride contains at least sodium chloride and potassium chloride, and a weight ratio thereof (KCl/NaCl) is at least 2.0.

CITATION LIST

Patent Literature

Patent Literature 1

Japanese Patent Application Publication Tokukai No. 2012-241277

Patent Literature 2

Japanese Patent Application Publication Tokukai No. 2014-88616

SUMMARY OF INVENTION

Technical Problem

However, the technique disclosed in Patent Literature 1 requires introduction of heating equipment in order to heat the steel material to be coated to 300° C. or higher, and restrictions are imposed on types of hot dip Zn—Al—Mg-based alloy coated steel products that can be produced. For example, when plating is applied to a large object, the heating equipment also needs to be large in size. Therefore, according to the technique disclosed in Patent Literature 1, it is difficult to use a large object as a steel material to be coated, and to apply hot dip Zn—Al—Mg-based alloy plating to such a large object.

Patent Literature 2 indicates that an average proportion of a region which has been evaluated to have no defects was 98%, as a result of visually evaluating plating defects on the surface of a long steel product (a steel wire or a steel bar) to which hot dip Zn—Al—Mg-based alloy plating has been applied. In the technique disclosed in Patent Literature 2, there is room for improvement in the surface condition of a plated steel product.

An aspect of the present invention is accomplished in view of the problems, and its object is to provide a technique that can produce a hot dip Zn—Al—Mg-based alloy coated steel product with a good plating appearance, without the need for heating of a steel product prior to immersion in a hot dip plating bath.

Solution to Problem

The inventors of the present invention have conducted diligent studies based on an assumption that plating appearance defects in hot dip Zn—Al—Mg-based alloy coated steel products produced by the one-bath method are caused because, in the plating bath, a residue (including $MgCl_2$) of chloride flux produced by reaction between a plating bath component and flux containing a chloride is difficult to detach from the surface of the steel product. As a result, it has been found that it is possible to obtain a hot dip Zn—Al—Mg-based alloy coated steel product with a beautiful plating appearance by adjusting the constituent composition of flux so that zinc chloride ($ZnCl_2$) is contained as a base composition and a low-reactive chloride (e.g., KCl and NaCl) having low reactivity with respect to Mg is contained in an appropriate ratio in order to cause the residue of chloride flux to detach more easily from the surfaces of the steel product in the plating bath. Based on this finding, the present invention has been accomplished.

That is, flux for hot dip Zn—Al—Mg-based alloy plating in accordance with an aspect of the present invention contains (i) $ZnCl_2$ and (ii) a low-reactive chloride which has low reactivity with respect to Mg in a plating bath and contains at least two chlorides selected from the compound group consisting of alkali metal chlorides and alkaline-earth metal chlorides. A composition of the $ZnCl_2$ and the low-reactive chloride is adjusted so that a liquidus temperature of the flux is 450° C. or lower even in a case where all of the $ZnCl_2$ contained in the flux has been substituted by $MgCl_2$.

Advantageous Effects of Invention

By using the flux in accordance with an aspect of the present invention, it is possible to produce a hot dip Zn—Al—Mg-based alloy coated steel product with a good plating appearance by a hot dip galvanizing method with a one-bath method, without the need for heating of a steel product prior to immersion in a hot dip plating bath (e.g. without the need for special equipment such as heating equipment).

DESCRIPTION OF EMBODIMENTS

Figure 1:
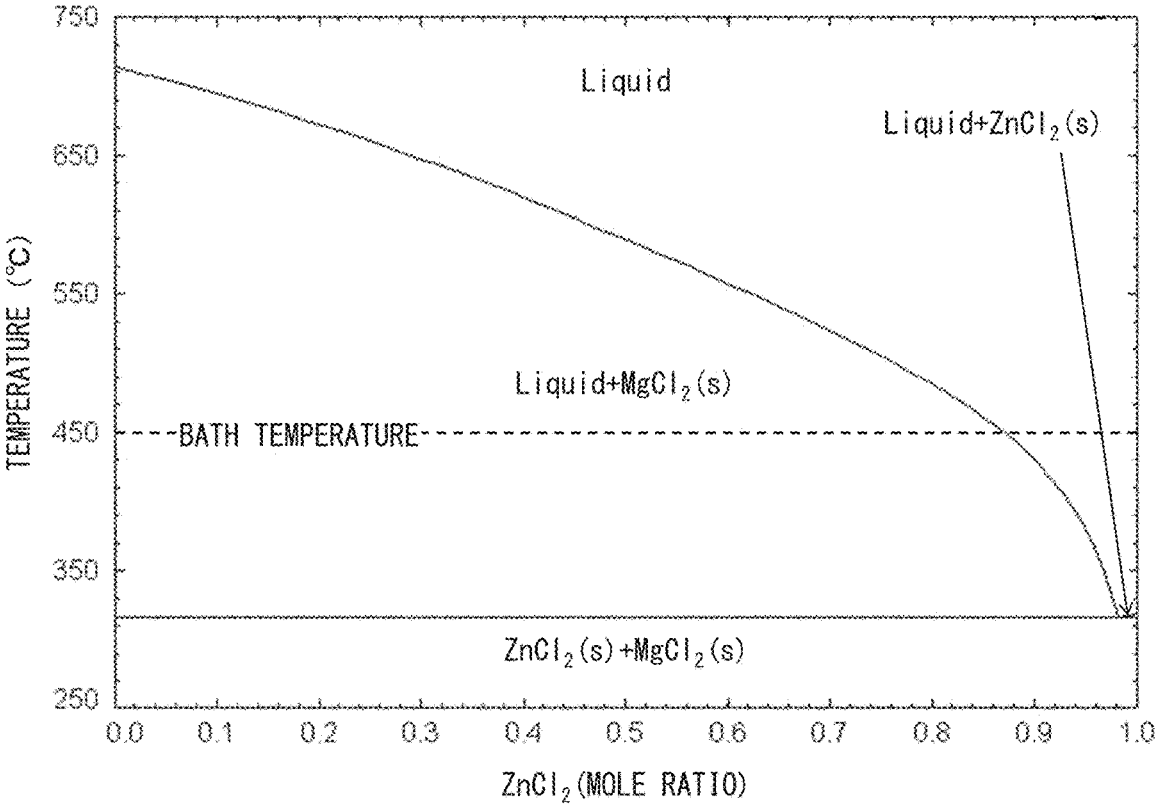
FIG. 1 is a pseudo binary system state diagram of $ZnCl_2$—$MgCl_2$.

The following description will discuss an embodiment of the present invention. Note that the following descriptions are aimed merely at better understanding of the gist of the invention, and do not limit the present invention unless otherwise specified. Moreover, in this specification, "A to B" means "A or more (higher) and B or less (lower)".

(Outline of Findings of the Present Invention)

First, an outline of the findings made by the inventors of the present invention is described as follows.

Flux used in the one-bath method generally has an effect of dissolving an oxide and the like on a surface of a steel product. Furthermore, flux is peeled off from the surface of the steel product in the plating bath and floats on the surface of the plating bath. This allows the clean surface of the steel product to be plated.

Generally, in the hot dip galvanizing method using pure Zn, flux which contains components including $ZnCl_2$ and ammonium chloride ($NH_4Cl$) is used as chloride-containing flux (chloride flux). Then, flux treatment is carried out by applying an aqueous solution in which the flux is dissolved in water to the surface of the steel product. When the steel product after the flux treatment is immersed in a plating bath, the flux is at a temperature of approximately 400° C., and consequently becomes a liquid (fused salt).

When a steel product is subjected to flux treatment using chloride flux having a common constituent composition as described above is immersed in a hot dip Zn—Al—Mg-based alloy plating bath and is then pulled up therefrom, plating defects occur in a hot dip Zn—Al—Mg-based alloy coated steel product obtained by such a process. For this phenomenon, the inventors of the present invention assumed as follows.

That is, the inventors of the present invention inferred that the residue of the chloride flux containing $MgCl_2$ and the like remains on (i.e., does not detach from) the surface of the steel product, and this causes plating defects such as roughness, bare spots, discoloration, and residue attachment. Such a cause has been conventionally recognized as a problem, and analysis has been conducted.

It is known that, when hot dip Zn—Al-based alloy plating is applied to a steel product, plating property is deteriorated by sublimation of flux caused by formation of $AlCl_3$. However, the mechanism of this phenomenon seems to differ from the problem that occurs when hot dip Zn—Al—Mg-based alloy plating is carried out. This is because Mg is considered to react preferentially because Mg is more reactive than Al.

Here, when the steel product which has been subjected to flux treatment is immersed in the hot dip Zn—Al—Mg-based alloy plating bath, a local reaction field where reaction occurs between (i) a surface of a steel product, (ii) fused flux, and (iii) hot dip Zn—Al—Mg-based alloy plating bath is referred to as "plating reaction field" in the following descriptions. Flux in the plating reaction field is referred to as "denatured flux".

Assuming that a composition of flux, which is a raw material of a flux bath used in the flux treatment, is a first composition, the denatured flux has a second composition which has been changed from the first composition by the reaction in the plating reaction field. The second composition can change with time.

The inventors of the present invention inferred that the denatured flux in the plating reaction field has an increased liquidus temperature due to change in composition caused by formation of $MgCl_2$ by reaction in the hot dip Zn—Al—Mg-based alloy plating bath. Then, the inventors of the present invention consequently inferred that the constituent composition of the denatured flux became a solid-liquid coexistence region at the bath temperature of the hot dip Zn—Al—Mg-based alloy plating bath, and this increased the viscosity of the denatured flux and made it difficult for the denatured flux to detach from the surface of the steel product.

This inference will be described below with reference to FIG. 1. FIG. 1 is a pseudo binary system state diagram of $ZnCl_2$—$MgCl_2$ (reference URL: http://www.crct.polymtl.ca/fact/phase_diagram.php?file=MgCl2-ZnCl2.jpg&dir=FTsalt>). As illustrated in FIG. 1, as an $MgCl_2$ concentration increases, a liquidus temperature in equilibrium of mixed salt of the $ZnCl_2$—$MgCl_2$ binary system increases. For example, assuming that the bath temperature is 450° C., at that temperature, a solid-liquid coexistence region (i.e., a region in which solid $MgCl_2$ and fused salt $ZnCl_2$—$MgCl_2$ co-exist) is obtained in a region in which a mass ratio calculated by an expression of $MgCl_2/(ZnCl_2+MgCl_2)$ is approximately 0.11 to 1.00. In general, it is known that a substance has remarkably increased viscosity in such a solid-liquid coexisting state, as compared with a liquid phase state.

If the bath temperature of the hot dip Zn—Al—Mg-based alloy plating bath is set to be higher, an increase in viscosity of the denatured flux can be inhibited. Nevertheless, such a measure is problematic in terms of stability of the hot dip Zn—Al—Mg-based alloy plating bath, operating cost, and the like. Moreover, if the bath temperature is increased, there also occurs a problem that heat distortion caused in the steel product becomes larger.

The inventors of the present invention have diligently studied to realize flux that makes it possible to produce a hot dip Zn—Al—Mg-based alloy coated steel product having a beautiful plating appearance, without increasing the bath temperature and also without pre-heating the steel product prior to immersion in the plating bath.

Here, solid chloride flux, which is a raw material used for preparation of a flux bath used in flux treatment, is simply referred to as "flux" in this specification. The flux is a solid flux composition containing chloride. A flux bath used in flux treatment is prepared by dissolving the flux in a solvent such as water (i.e., the flux serves as a solute in the flux bath).

The flux contains $ZnCl_2$ as a base substance of a constituent composition. Use of fluoride is unfavorable in terms of environmental regulations, and therefore the flux does not contain fluoride (e.g., NaF).

$MgCl_2$ has low free energy of formation due to high reactivity of Mg. Therefore, Mg in the hot dip Zn—Al—Mg-based alloy plating bath easily reacts with chloride (such as $ZnCl_2$), which is a component of the flux, to form $MgCl_2$. The resulting $MgCl_2$ is incorporated into the denatured flux in the plating reaction field. In other words, the denatured flux necessarily contains $MgCl_2$ unless flux is composed only of chloride which is more stable than $MgCl_2$. Meanwhile, chloride which is more stable than $MgCl_2$ has a weaker effect as flux.

The inventors of the present invention focused on the denatured flux in the plating reaction field, and studied a liquidus temperature in a mixed salt composition of NaCl and KCl, which are chlorides having low reactivity with respect to Mg, and $MgCl_2$. Specifically, based on a liquidus surface diagram of $MgCl_2$—NaCl—KCl obtained by simulation using thermodynamic equilibrium computation software (FactSage), compositional regions having a liquidus temperature of 450° C. or lower were analyzed.

Here, the liquidus surface diagram of $MgCl_2$—NaCl—KCl shows a relation between the constituent composition and the liquidus temperature of the denatured flux in a case where the denatured flux is composed of three components, i.e., $MgCl_2$—NaCl—KCl. In practice, the denatured flux can contain chloride (e.g., $ZnCl_2$) which is not substituted by Mg. Therefore, the relation between the constituent composition and the liquidus temperature of the denatured flux in the plating reaction field does not conform to the liquidus surface diagram of $MgCl_2$—NaCl—KCl. However, as mentioned above (see FIG. 1), as the proportion of $MgCl_2$ increases, the liquidus temperature becomes higher. From this, it is possible to consider that the liquidus surface diagram of $MgCl_2$—NaCl—KCl shows a case where all of $ZnCl_2$ in the denatured flux has been substituted by $MgCl_2$ (i.e., a state in which the liquidus temperature is highest). That is, it is only necessary to specify the liquidus temperature on the assumption that the denatured flux has the constituent composition in which all of $ZnCl_2$ contained in flux has been substituted by $MgCl_2$ (substitution ratio: 100%). This is because the liquidus temperature of the denatured flux tends to decrease as the substitution ratio becomes lower.

In view of this, the inventors of the present invention have diligently studied a suitable composition range for flux containing $ZnCl_2$, NaCl and KCl based on the compositional region in which the liquidus temperature which is shown by the liquidus surface diagram of $MgCl_2$—NaCl—KCl is 450° C. or lower. Here, the bath temperature was 450° C. The findings obtained as a result will be described below with reference to FIG. 2.

Figure 2:
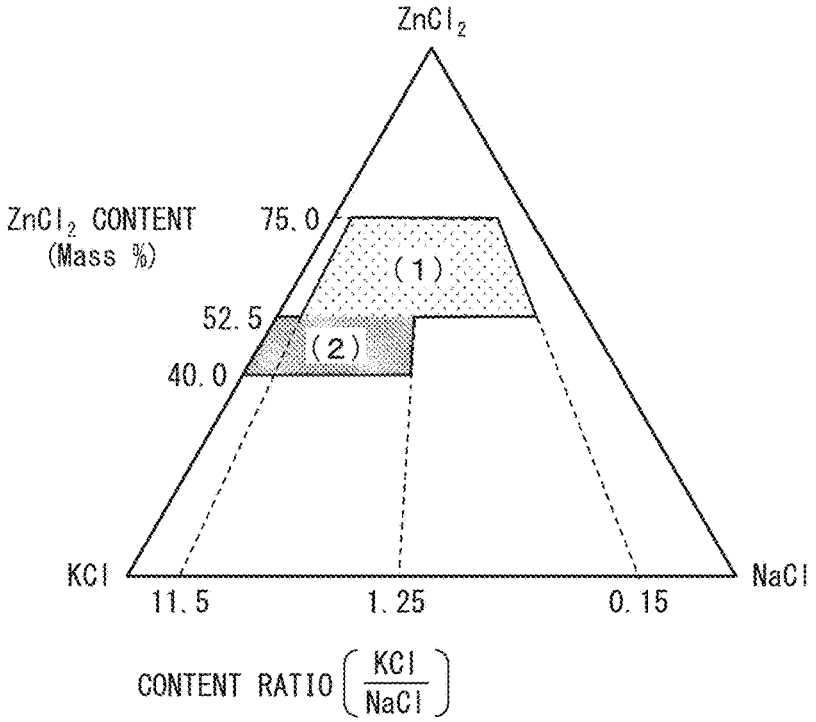
FIG. 2 is a diagram for explaining ranges of components of flux in an aspect of the present invention in a case where a hot dip Zn—Al—Mg-based alloy plating bath has a bath temperature of, for example, 450° C.

FIG. 2 is a diagram for explaining ranges of components of flux with which a hot dip Zn—Al—Mg-based alloy coated steel product with a beautiful plating appearance can be produced when a hot dip Zn—Al—Mg-based alloy plating bath has a bath temperature of, for example, 450° C.

The flux in accordance with an aspect of the present invention contains $ZnCl_2$, and NaCl and KCl, and has a constituent composition falling within the region surrounded by the solid lines in FIG. 2. This region is specifically a constituent composition of the following (1) or (2).

(1) A contained amount of $ZnCl_2$ is not less than 52.5% by mass and not more than 75.0% by mass, a total contained amount of NaCl and KCl is not less than 25.0% by mass and not more than 47.5% by mass, and a mass ratio (KCl/NaCl) of KCl and NaCl is 0.15 or more and 11.5 or less.

(2) A contained amount of $ZnCl_2$ is not less than 40.0% by mass and less than 52.5% by mass, a total contained amount of NaCl and KCl is more than 47.5% by mass and not more than 60.0% by mass, and a mass ratio (KCl/NaCl) of KCl and NaCl is 1.25 or more.

By using the flux which has the constituent composition of the above (1) or (2), it is easy to set the liquidus temperature of the denatured flux to be 450° C. or lower in the case where all of $ZnCl_2$ is assumed to have been substituted by $MgCl_2$. Therefore, an increase in viscosity of the denatured flux is inhibited, and the denatured flux can be easily detached from the surface of the steel product. As a result, it is possible to produce a hot dip Zn—Al—Mg-based alloy coated steel product having a beautiful plating appearance, without increasing the bath temperature and also without pre-heating the steel product prior to immersion in the plating bath.

Note that, according to the findings of the inventors of the present invention described above, chloride contained in the flux in accordance with an aspect of the present invention is not limited to the above examples (i.e., NaCl and KCl). In this specification, a chloride which has low reactivity with respect to Mg in a plating bath and contains at least two chlorides selected from the compound group consisting of alkali metal chlorides and alkaline-earth metal chlorides is referred to as "low-reactive chloride".

The flux in accordance with another aspect of the present invention contains $ZnCl_2$ as a main component and contains the low-reactive chloride, in which a composition of the $ZnCl_2$ and the low-reactive chloride is adjusted so that a liquidus temperature of the flux is 450° C. or lower in a case where all of the $ZnCl_2$ contained in the flux is assumed to have been substituted by $MgCl_2$. When the low-reactive chloride is added in an appropriate amount to form a reaction product of the flux and the constituent components of the hot dip Zn—Al—Mg-based alloy plating bath in the plating reaction field, the low-reactive chloride added to the flux causes a melting point depression effect on the denatured flux. Thus, the denatured flux maintains the liquid phase state at the bath temperature of the hot dip Zn—Al—Mg-based alloy plating bath. Therefore, detachability of the denatured flux is sufficiently secured. Consequently, it is possible to obtain a beautiful plating appearance without the need for heating of the steel product.

The low-reactive chloride preferably contains NaCl and KCl. The low-reactive chloride can contain another alkali metal chloride and/or another alkaline-earth metal chloride and, even in such a case, a melting point depression effect on the denatured flux can also be achieved.

The following description will discuss an embodiment of the present invention with reference to a method for producing a hot dip Zn—Al—Mg-based alloy coated steel product.

(Production Method)

Figure 3:
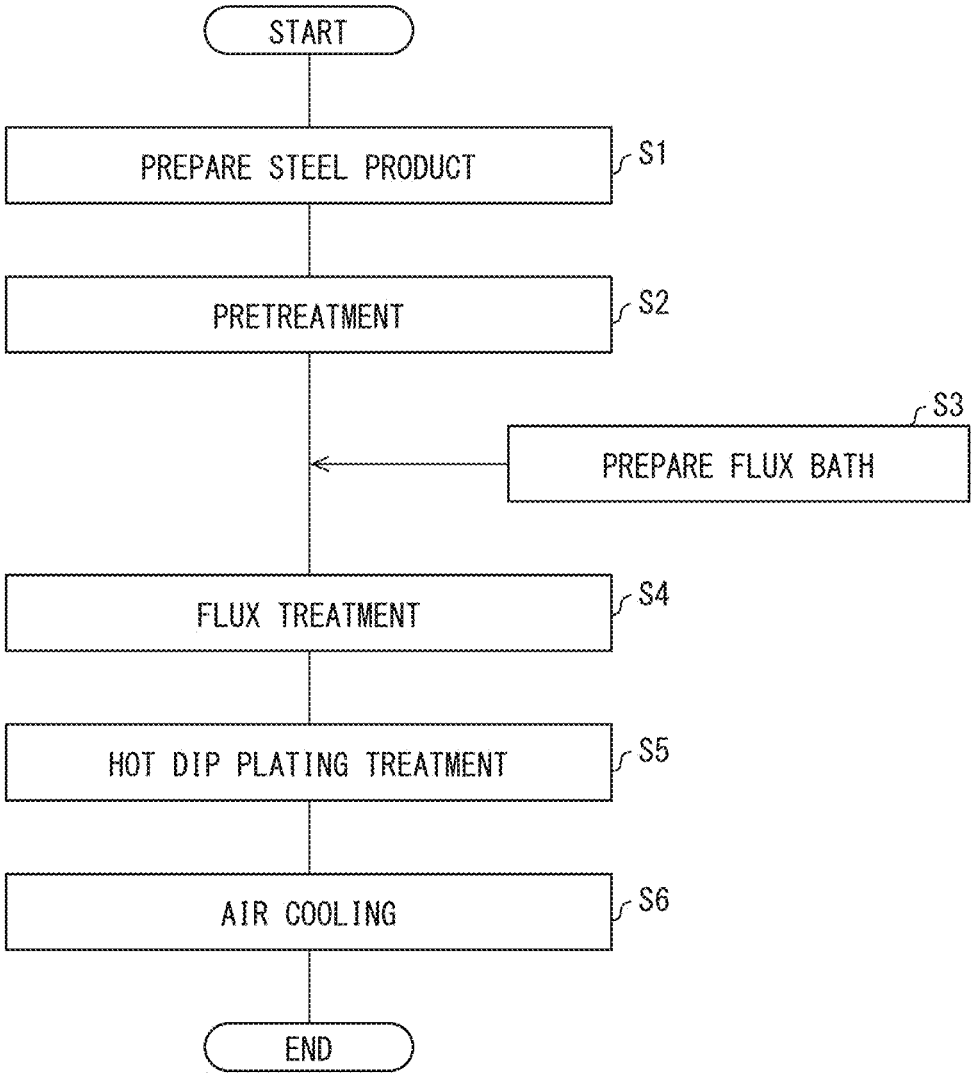
FIG. 3 is a flowchart showing an example method for producing a hot dip Zn—Al—Mg-based alloy coated steel product in accordance with an embodiment of the present invention.
Figure 4:
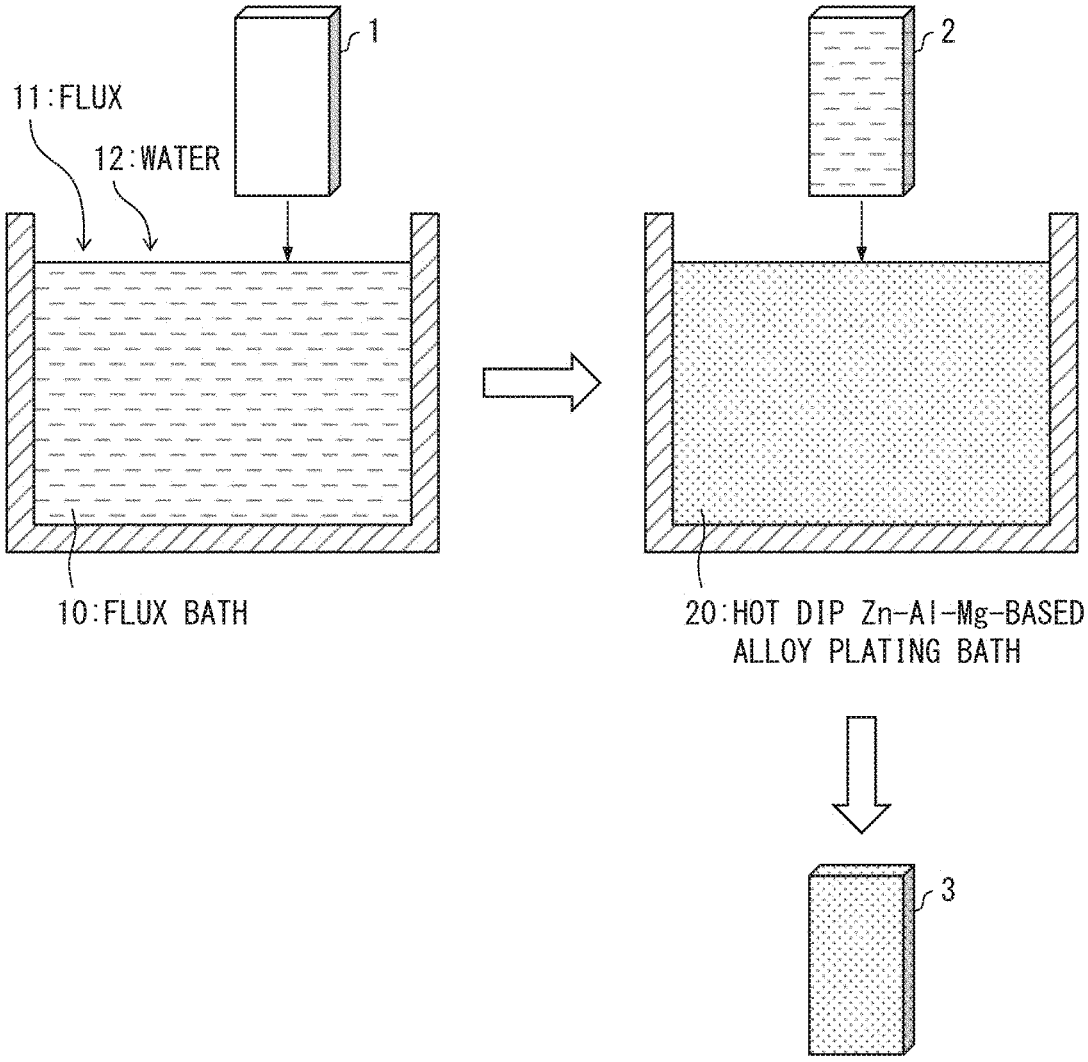
FIG. 4 is a schematic diagram for explaining a state in which hot dip plating is carried out in a one-bath method.

FIG. 3 is a flowchart showing an example method for producing a hot dip Zn—Al—Mg-based alloy coated steel product. FIG. 4 is a schematic diagram for explaining a state in which hot dip plating is carried out in a one-bath method.

(Preparation)

As illustrated in FIG. 3 and FIG. 4, in the method for producing the hot dip Zn—Al—Mg-based alloy coated steel product, first, a steel product (material to be plated) 1 which is to be plated is prepared (step 1; hereinafter abbreviated as S1).

(Steel Product)

The steel product 1 can be a steel material or a steel structure, for example, a rolled steel material, a pipe, a workpiece, a bolt/nut, or a cast and forged product. The steel material can be, for example, a cold-rolled steel plate (SPCC) or a hot-rolled steel plate (SPHC), or a general structural rolled steel material (SS). A steel type of the steel material can be: a tool steel such as a carbon tool steel (SK), an alloy tool steel, or a high-speed tool steel; a machine structural steel (SC); or the like. The steel product 1 can be a steel pipe made of various types of carbon steel (e.g., a carbon steel pipe for piping (SGP)).

A shape of the steel structure is not particularly limited, and can be any of various shapes such as, for example, a wire shape such as a steel wire, a sheet shape such as a steel sheet, a net shape, a tubular shape such as a steel pipe, a three-dimensional shape such as a rod shape, and the like. The steel product 1 can be, for example, (i) a small base material such as a bolt, a nut, or a power transmission metal fitting, or (ii) a large base material such as a balustrade, a newel post, a protective fence for a bridge, a road sign, a card fence for a road, a fence for a river, a rock fall prevention net, or a steel pipe. In particular, in the production method in accordance with an aspect of the present invention, it is not necessary to pre-heat the steel product 1 prior to plating, and it is therefore possible to suitably carry out hot dip Zn—Al—Mg-based alloy plating even with respect to a large structure.

A steel type of the steel product 1 is not particularly limited and, for example, it is possible to employ various steel types such as Al-killed steel; Si-killed steel; ultra-low carbon steel containing Ti, Nb, and the like; high strength steel containing these steel components and also strengthening elements such as P, Si, and Mn; and stainless steel.

For example, the steel product 1 can be a steel material containing, in % by mass, 0.005% or more and 0.15% or less of C, 0.001% or more and 0.25% or less of Si, 0.40% or more and 1.6% or less of Mn, 0.04% or less of P, 0.04% or less of S, 0.001% or more and 0.06% or less of Al, and 0.0080% or less of N. The remainder of the steel material can include Fe and inevitable impurities. Such steel materials are inexpensive and excellent in processability, and are optimal for use in piping, building materials, civil engineering, agriculture, and fishery, mainly as an underlying steel material for a hot dip coated steel material which is to be used outdoors.

For example, the steel type of the steel product 1 can be as follows.

An example of low-Si and low-P steel material (weakly deoxidized steel)
0.003C-0.007Si-0.23Mn-0.006P-0.013S An example of low-Si and high-P steel material
0.003C-0.01Si-0.23Mn-0.012P-0.013S An example of high-Si and low-P steel material
0.003C-0.007Si-0.23Mn-0.012P-0.013S An example of high-Si and high-P steel material (corresponding to the foregoing SGP)
0.15C-0.21Si-0.52Mn-0.035P-0.0085-0.002Al-0.003N (Pretreatment)

After S1, pretreatment is carried out on the steel product 1 (S2). As the pretreatment, for example, degreasing treatment, water washing treatment, pickling treatment, and water washing treatment are carried out in this order. A specific method of the pretreatment is not particularly limited, and a known method can be used. Therefore, a detailed description thereof is omitted.

(Flux Bath Preparation)

After S2, or independently of S1 and S2, a flux bath is prepared (S3). The flux bath 10 is produced by dissolving flux (flux for hot dip Zn—Al—Mg-based alloy plating) 11 in accordance with an aspect of the present invention in water 12. To the flux bath 10, hydrochloric acid (HCl), a nonionic surfactant, or other substances can be added.

(Components in Flux)

As described above, flux 11 mainly contains $ZnCl_2$ and contains the low-reactive chloride.

$ZnCl_2$ is a fundamental component of the flux 11. $ZnCl_2$ is a chloride which acts in a plating bath to remove an oxide coating on the surface of the steel product 1 so that the clean surface of the steel product 1 is plated.

Here, conventional common flux contains $NH_4Cl$. However, $NH_4Cl$ easily reacts with Mg and can decompose and sublime in the plating reaction field to complicate the constituent composition of the denatured flux. The flux 11 in accordance with an aspect of the present invention has the constituent composition defined by the technical idea described above, and therefore does not contain or substantially does not contain $NH_4Cl$. The flux 11 does not contain or substantially does not contain both $NH_4Cl$ and fluoride (e.g., NaF).

Note that, in this specification, the phrase "substantially does not contain" a certain substance means that the substance is not added in the producing process of the flux 11. In this case, it is permissible that the flux contains the substance as an inevitable impurity.

The low-reactive chloride can be any chloride that can stably exist in the plating reaction field in the hot dip Zn—Al—Mg-based alloy plating bath. That is, the low-reactive chloride only needs to have the free energy of formation that is lower than that of $MgCl_2$. As such a low-reactive chloride, it is possible to select an alkali metal chloride or an alkaline-earth metal chloride.

For example, a binary mixture of $MgCl_2$ and a chloride, which is one selected from among various kinds of alkali metal chloride and alkaline-earth metal chloride except NaCl and KCl, has a liquidus temperature higher than the mean bath temperature, i.e., 450° C. However, in a case where at least two of alkali metal chlorides and alkaline-earth metal chlorides are selected and the selected chlorides are contained in the constituent composition of the flux 11, the denatured flux becomes a mixture of three or more components, i.e., the selected two or more chlorides and $MgCl_2$. As a result, the liquidus temperature of the denatured flux can be reduced to 450° C. or lower.

Therefore, the low-reactive chloride can contain two or more chlorides arbitrarily selected from alkali metal chlorides and alkaline-earth metal chlorides, provided that a composition of $ZnCl_2$ and the low-reactive chloride is adjusted so that a liquidus temperature of the denatured flux is 450° C. or lower in a case where all of $ZnCl_2$ contained in the flux 11 is assumed to have been substituted by $MgCl_2$.

NaCl and KCl have a great melting point depression effect with respect to denatured flux, and it is therefore preferable that the low-reactive chloride contains NaCl and KCl.

(X) It is preferable that the flux 11 contains NaCl and KCl as the low-reactive chloride, a contained amount of $ZnCl_2$ is not less than 52.5% by mass and not more than 75.0% by mass, a total contained amount of NaCl and KCl is not less than 25.0% by mass and not more than 47.5% by mass, and a mass ratio (KCl/NaCl) of KCl and NaCl is 0.15 to 11.5.

(Y) Further, it is preferable that the flux 11 contains NaCl and KCl as the low-reactive chloride, a contained amount of $ZnCl_2$ is not less than 40.0% by mass and less than 52.5% by mass, a total contained amount of NaCl and KCl is more than 47.5% by mass and not more than 60.0% by mass, and a mass ratio (KCl/NaCl) of KCl and NaCl is 1.25 or more.

The flux 11 can be composed only of $ZnCl_2$ and the low-reactive chloride. In this case, the relation (X) or (Y) is satisfied, and the total contained amount of $ZnCl_2$ and the low-reactive chloride is substantially 100% by mass. The phrase "substantially 100% by mass" means that inevitable impurities may be contained. That is, in the flux 11 in accordance with an aspect of the present invention, a total contained amount of $ZnCl_2$, the low-reactive chlorides (NaCl and KCl), a low-reactive chloride other than NaCl and KCl (other components; for example, an auxiliary chloride described later), and inevitable impurities is 100% by mass. The constituent composition of the flux 11 is adjusted so that the liquidus temperature of the denatured flux is 450° or less.

In the flux 11 in accordance with an aspect of the present invention, the total amount of $ZnCl_2$, the low-reactive chloride, components other than the low-reactive chloride, and inevitable impurities can be 100% by mass. In this case, the mass percentage described in (X) or (Y) above is calculated on the assumption that a total mass of $ZnCl_2$ and the low-reactive chloride is 100 parts by mass. Note that the "mass ratio of KCl and NaCl" described in (X) or (Y) above is a value determined based on the composition of KCl and NaCl in the flux 11 (e.g., a value of mass percentage). That is, the term does not mean the proportion of KCl and NaCl contained in the low-reactive chloride.

RbCl, which is one of the low-reactive chlorides, can react with $MgCl_2$ to form a compound having a melting point of 550° C. or higher. In a case where a combination KCl—$CaCl_2$ or a combination KCl—$SrCl_2$ is contained as the low-reactive chloride, the combination can similarly react with $MgCl_2$ to form a compound having a melting point of 550° C. or higher. $BeCl_2$ contains Be and is therefore difficult to use proactively.

Therefore, it is preferable to use a chloride other than RbCl and $BeCl_2$ as the low-reactive chloride. It is preferable that the flux 11 does not contain a combination KCl—$CaCl_2$ or a combination KCl—$SrCl_2$ as the low-reactive chloride.

The flux 11 is a solid composition serving as a raw material for preparing a flux aqueous solution (flux bath), and can be in a form of molded product (such as pellets), powder, or in other form.

The flux 11 can further contain an auxiliary chloride which is at least one chloride among chlorides of Sn, Pb, and Bi. In the plating reaction field in the hot dip Zn—Al—Mg-based alloy plating bath, Sn, Pb, and/or Bi of the auxiliary chloride is precipitated by substitution on the surface of the steel product, and this improves the plating property of the steel product.

Meanwhile, the free energy of formation of $SnCl_2$, $PbCl_2$, or $BiCl_3$ is higher than that of $MgCl_2$. Therefore, $SnCl_2$, $PbCl_2$, or $BiCl_3$ contained in the flux 11 reacts with Mg in the hot dip Zn—Al—Mg-based alloy plating bath to form $MgCl_2$, and thus acts to increase the liquidus temperature of the denatured flux.

Therefore, it is preferable that the flux 11 contains the auxiliary chloride in a total amount of more than 0% by mass and less than 10.0% by mass. The auxiliary chloride provides a plating property improving effect even with a small amount. If the auxiliary chloride is contained in a total amount of not less than 10.0% by mass, the flux 11 can cause precipitation of the auxiliary chloride by exceeding the solubility in a flux aqueous solution. In addition, if the flux 11 contains the auxiliary chloride in a total amount of not less than 10.0% by mass, detachability of flux residue can be deteriorated due to an increase in the liquidus temperature of the flux residue.

Further, it is more preferable that the flux 11 contains the auxiliary chloride in a total amount of not less than 1.0% by mass and not more than 6.0% by mass. The effect can be weak if the amount is less than 1.0% by mass, and the effect can be saturated if the amount is more than 6.0% by mass.

In a case where the flux 11 contains the auxiliary chloride, the composition of $ZnCl_2$ and the low-reactive chloride only needs to be adjusted as in (X) or (Y) above, where the total mass of $ZnCl_2$ and the low-reactive chloride (excluding the auxiliary chloride) in the remainder excluding the total amount of the auxiliary chloride is assumed to be 100 parts by mass.

(Flux Bath)

It is preferable that the flux bath 10 has pH which is adjusted to 3 or less. As the pH increases, a hydroxide of the auxiliary chloride can be generated, and the amounts of Sn, Pb, and Bi ions in the flux bath 10 can be reduced.

HCl is used to adjust the pH of the flux bath 10. By using HCl, it is possible to prevent an increase in the type of ions in the flux bath 10.

The flux bath 10 preferably has a concentration of the flux 11 of 150 g/L or more and 750 g/L or less. If the concentration of the flux 11 is lower than 150 g/L, the effect of the flux 11 is not sufficiently exhibited. If the concentration of the flux 11 exceeds 750 g/L, economical efficiency is deteriorated and the flux 11 may not be sufficiently dissolved.

(Flux Treatment)

After S2 and S3, the pretreated steel product 1 is immersed in the flux bath 10 and is then pulled up therefrom, and thus flux treatment is applied (S4: flux treatment step).

The temperature of the flux bath 10 can be 80° C. or lower, e.g., 60° C. The duration of immersion of the steel product 1 in the flux bath 10 can be 5 min or less, for example, 1 min.

The steel product 1, which has been immersed in the flux bath 10, so that the flux bath 10 is attached to the surface of the steel product 1, is referred to as "flux-treated product 2". The flux-treated product 2 can be heated and dried prior to a hot dip plating step described later. Alternatively, the flux-treated product 2 can be subjected to the hot dip plating step without being heated.

(Hot Dip Plating Treatment)

After S4, the flux-treated product 2 is immersed in the hot dip Zn—Al—Mg-based alloy plating bath 20 and is then pulled up therefrom, and thus hot dip plating treatment is applied (S5: hot dip plating step).

The hot dip Zn—Al—Mg-based alloy plating bath 20 contains Zn as a main component, and contains, in % by mass, 0.005% or more and 30.0% or less of Al, and 0.5% or more and 10.0% or less of Mg. The hot dip Zn—Al—Mg-based alloy plating bath 20 can contain, in % by mass, 0.5% or more and 15.0% or less of Al, and 0.5% or more and 6.0% or less of Mg.

The hot dip Zn—Al—Mg-based alloy plating bath 20 can satisfy one or more conditions selected from the group consisting of Ti: 0% by mass to 0.1% by mass, B: 0% by mass to 0.05% by mass, Si: 0% by mass to 2.0% by mass, and Fe: 0% by mass to 2.5% by mass.

In this production method, the bath temperature of the hot dip Zn—Al—Mg-based alloy plating bath 20 is 450° C. or lower. However, as a constraint of the bath temperature, the bath temperature needs to be equal to or higher than the liquidus temperature of the hot dip Zn—Al—Mg-based alloy plating bath 20 in accordance with the composition of the hot dip Zn—Al—Mg-based alloy plating bath 20. Moreover, in plating of a structure, the bath temperature is preferably 430° C. to 460° C. because of the problem of heat distortion. Meanwhile, in plating of a bolt, nut, or the like, the bath temperature is preferably 480° C. to 560° C. from the viewpoint of ensuring bath fluidity. Thus, the bath temperature can be adjusted according to the conditions. The bath temperature can range, for example, from 400° C. to 570° C.

The immersion time in the hot dip Zn—Al—Mg-based alloy plating bath 20 can be 600 seconds or less, for example 100 seconds. The pulling-up speed from the plating bath is restricted by equipment or the like, and is therefore not particularly limited. The pulling-up speed can be any speed as long as the speed is appropriate for draining off the plating bath. The pulling-up speed can be, for example, 50 mm/s.

In this production method, it is not necessary to heat the flux-treated product 2. In S5, the flux-treated product 2 can be immersed in the hot dip Zn—Al—Mg-based alloy plating bath 20 at a temperature below 300° C. or at a normal temperature. Here, the "normal temperature" means that heating by a heating device or the like is not carried out. The flux-treated product 2 can be temporarily held above the hot dip Zn—Al—Mg-based alloy plating bath 20 in actual operation. In this case, the flux-treated product 2 can be heated by radiant heat or the like from the hot dip Zn—Al—Mg-based alloy plating bath 20. In this specification, the normal temperature means a temperature of, for example, 80° C. or lower.

In this production method, the flux-treated product 2 having the surface to which the flux bath 10 (i.e., a flux aqueous solution) is attached can be immersed in the hot dip Zn—Al—Mg-based alloy plating bath 20. In this case, the plating reaction field can include water.

This production method does not exclude a case where the flux-treated product 2 is heated. For example, the flux-treated product 2 can be heated and dried for 3 min at 175° C. using an electric furnace and then immersed in the hot dip Zn—Al—Mg-based alloy plating bath 20.

(Cooling)

After S5, the flux-treated product 2 is pulled up from the hot dip Zn—Al—Mg-based alloy plating bath 20 and then cooled (e.g., air-cooled). Thus, a hot dip Zn—Al—Mg-based alloy coated steel product 3 can be obtained (S6).

Figure 5:
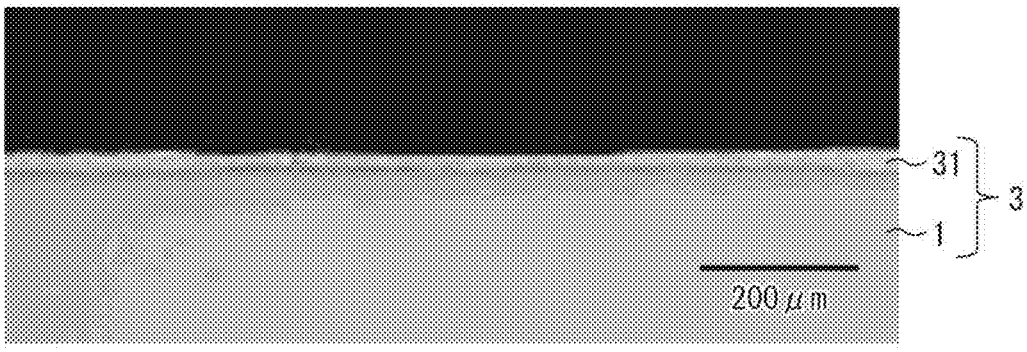
FIG. 5 is an optical photomicrograph showing an example of a cross section of a hot dip Zn—Al—Mg-based alloy coated steel product produced by a production method in accordance with an embodiment of the present invention.

FIG. 5 is an optical photomicrograph showing an example of a cross section of a hot dip Zn—Al—Mg-based alloy coated steel product 3. The hot dip Zn—Al—Mg-based alloy coated steel product 3 is obtained by coating the surface of the steel product 1 with a Zn-6% Al-3% Mg-coating layer 31. The flux bath 10 had a composition of $ZnCl_2$: 250 g/L, NaCl: 37.5 g/L, KCl: 50 g/L, and $SnCl_2$: 20 g/L, and had the pH which was adjusted to 1 by adding an appropriate amount of HCl.

As shown in FIG. 5, this production method can produce the hot dip Zn—Al—Mg-based alloy coated steel product 3 having a beautiful plating appearance, without a plating defect.

[Additional Remarks]

The present invention is not limited to the embodiment, but can be altered by a skilled person in the art within the scope of the claims. The present invention also encompasses in its technical scope any embodiment based on an appropriate combination of the technical means disclosed in the descriptions.

Example 1

The following description will discuss a working example of the present invention.

A steel sheet indicated in Table 1 was cut in a size of 200 mm×60 mm, and thus a sample material was obtained. Components other than elements listed in Table 1 were mainly Fe, and the other elements were not analyzed.

TABLE 1

| Steel | Steel material component (mass %) | | | | | |
|---|---|---|---|---|---|---|
| type | C | Si | Mn | P | S | Al |
| A | 0.03 | 0.01 | 0.23 | 0.008 | 0.007 | 0.008 |
| B | 0.05 | 0.01 | 0.22 | 0.021 | 0.013 | 0.007 |
| C | 0.03 | 0.19 | 0.25 | 0.008 | 0.008 | 0.004 |
| D | 0.15 | 0.21 | 0.52 | 0.032 | 0.008 | 0.002 |

With respect to the sample material, degreasing was carried out using a commercially available alkaline degreasing agent, and then pickling was carried out with a 10% HCl aqueous solution at 60° C. until an oxide coating was taken off. After that, the sample material was washed with water, and then subjected to flux treatment.

The flux treatment was carried out by immersing the pickled sample material for 1 minute in each of flux aqueous solutions (flux concentration: 250 g/L; temperature: 60° C.)

having various compositions in which pH was adjusted to 2 or less by adding an appropriate amount of HCl. Next, the sample material was kept in an oven heated to 170° C. for 3 minutes to completely evaporate water, and was then subjected to plating. The sample material subjected to flux treatment was plated by being immersed, for 100 seconds, in a hot dip Zn—Al—Mg plating bath which was at the bath temperature of 450° C. and had the composition indicated in Table 2. The sample material after plating was cooled to 50° C. by air cooling.

TABLE 2

| Plating bath composition (mass %) | | | | | |
|---|---|---|---|---|---|
| Al | Mg | Si | Ti | B | Zn |
| 5.9 | 2.8 | 0.03 | 0.02 | 0.005 | Remainder |

<Evaluation Method>

The sample material after plating was evaluated for appearance and remaining flux amount in accordance with the following criteria.

The appearance of the sample material after plating was visually confirmed and evaluated in accordance with the criterion indicated in Table 3.

TABLE 3

| Evaluation | Criterion |
|---|---|
| Good | Bare spots and residue attachment are not visually seen |
| Not good | Slight bare spots, slight residue attachment (size: 1 mm or less and frequency: 2 pieces/100 $cm^2$ or less), or slight discoloration (area ratio: 5-10%) is visually seen |
| Bad | Bare spots, residue attachment, discoloration, or significant roughness is visually seen |

As the method of evaluating the remaining flux amount, the sample material (steel sheet) surface after plating was measured by X-ray fluorescence (XRF) to evaluate, on the basis of Cl intensity, the remaining amount of flux residues which cause deterioration of the plating appearance (bare spots, residue attachment, discoloration, roughness, and the like). Details of the evaluation method are described below.

Samples for analysis were prepared by punching out the sample materials. As an analysis device, ZSX Primus III+ available from RIGAKU was used, and an analysis range of the samples was set to ϕ30 mm. Measurements were carried out with EZ-scan program settings (target: Rh, 30 kV-80 mA; dispersive crystal: Ge; detector: proportional counter; measurement peak: 92.8°; detector rate: 10 deg/min). The measurements were carried out n=3 (i.e., 3 times) per condition, and the average Cl intensity was calculated. As evaluation criteria, the average Cl intensity of 0.6 kcps or less was evaluated as Good, and the average Cl intensity of more than 0.6 kcps was evaluated as Bad.

The test results are indicated in Tables 4 and 5.

TABLE 4

| | | Flux composition (mass %) | | | | | | Flux concentration | Average Cl intensity | Appearance | Remaining flux |
|---|---|---|---|---|---|---|---|---|---|---|---|
| Class | No | $ZnCl_2$ | $NH_4Cl$ | NaCl | KCl | NaF | KCl/NaCl | (g/L) | (kcps) | evaluation | evaluation |
| Examples of present invention | 1 | 52.5 | 0.0 | 4.0 | 43.5 | 0.0 | 10.88 | 250 | 0.50 | Good | Good |
| | 2 | 52.5 | 0.0 | 21.5 | 26.0 | 0.0 | 1.21 | | 0.42 | Good | Good |
| | 3 | 52.5 | 0.0 | 40.0 | 7.5 | 0.0 | 0.19 | | 0.58 | Good | Good |
| | 4 | 60.0 | 0.0 | 30.0 | 10.0 | 0.0 | 0.33 | | 0.55 | Good | Good |
| | 5 | 62.5 | 0.0 | 3.0 | 34.5 | 0.0 | 11.50 | | 0.47 | Good | Good |
| | 6 | 66.0 | 0.0 | 15.0 | 19.0 | 0.0 | 1.27 | | 0.34 | Good | Good |
| | 7 | 70.0 | 0.0 | 6.5 | 23.5 | 0.0 | 3.62 | | 0.46 | Good | Good |
| | 8 | 74.0 | 0.0 | 11.0 | 15.0 | 0.0 | 1.36 | | 0.53 | Good | Good |
| | 9 | 74.0 | 0.0 | 2.5 | 23.5 | 0.0 | 9.40 | | 0.49 | Good | Good |
| | 10 | 74.0 | 0.0 | 8.0 | 18.0 | 0.0 | 2.25 | | 0.52 | Good | Good |
| | 11 | 74.0 | 0.0 | 20.0 | 6.0 | 0.0 | 0.30 | | 0.59 | Good | Good |
| | 12 | 40.0 | 0.0 | 4.0 | 56.0 | 0.0 | 14.00 | | 0.50 | Good | Good |
| | 13 | 40.0 | 0.0 | 26.0 | 34.0 | 0.0 | 1.31 | | 0.55 | Good | Good |
| | 14 | 45.0 | 0.0 | 17.5 | 37.5 | 0.0 | 2.14 | | 0.48 | Good | Good |
| | 15 | 50.0 | 0.0 | 2.0 | 48.0 | 0.0 | 24.00 | | 0.50 | Good | Good |
| Comparative examples | 16 | 72.0 | 28.0 | 0.0 | 0.0 | 0.0 | — | | 8.01 | Bad | Bad |
| | 17 | 88.0 | 12.0 | 0.0 | 0.0 | 0.0 | — | | 7.82 | Bad | Bad |
| | 18 | 54.0 | 21.0 | 11.0 | 14.0 | 0.0 | 1.27 | | 1.31 | Not good | Bad |
| | 19 | 80.0 | 0.0 | 20.0 | 0.0 | 0.0 | 0.00 | | 2.47 | Bad | Bad |
| | 20 | 87.5 | 0.0 | 10.0 | 0.0 | 2.0 | 0.00 | | 2.53 | Bad | Bad |
| | 21 | 74.0 | 0.0 | 0.0 | 26.0 | 0.0 | — | | 1.71 | Bad | Bad |
| | 22 | 74.0 | 0.0 | 23.0 | 3.0 | 0.0 | 0.13 | | 0.82 | Not good | Bad |
| | 23 | 74.0 | 0.0 | 2.0 | 24.0 | 0.0 | 12.00 | | 0.66 | Not good | Bad |
| | 24 | 75.0 | 0.0 | 12.5 | 12.5 | 0.0 | 1.00 | | 0.64 | Not good | Bad |
| | 25 | 52.5 | 0.0 | 42.0 | 5.5 | 0.0 | 0.13 | | 0.90 | Not good | Bad |
| | 26 | 45.0 | 0.0 | 25.0 | 30.0 | 0.0 | 1.20 | | 0.69 | Not good | Bad |
| | 27 | 39.0 | 0.0 | 25.0 | 36.0 | 0.0 | 1.44 | | 0.61 | Not good | Bad |
| | 28 | 39.0 | 0.0 | 2.5 | 58.5 | 0.0 | 23.40 | | 0.63 | Not good | Bad |

As indicated in No. 1 through No. 15 in Table 4, the sample materials after plating of examples of the present invention, which were subjected to flux treatment using flux having the compositions falling within the range of the present invention, were evaluated to have good appearances. In addition, the sample materials No. 1 through No. 15 had the average Cl intensity of 0.6 kcps or less, and thus the evaluation for remaining flux was also Good.

In contrast, in the comparative examples No. 16 through No. 28 in which the flux compositions fell outside the range of the present invention, the evaluations for remaining flux were all Bad, and the appearance evaluations were also Not Good or Bad.

TABLE 5

| | | Flux composition (mass %) | | | | | | | | Flux concentration | Average Cl intensity | Appearance | Remaining flux |
|---|---|---|---|---|---|---|---|---|---|---|---|---|---|
| Class | No | $ZnCl_2$ | $NH_4Cl$ | NaCl | KCl | $SnCl_2$ | $PbCl_2$ | $BiCl_3$ | KCl/NaCl | (g/L) | (kcps) | evaluation | evaluation |
| Examples of present invention | 29 | 70.0 | 0.0 | 10.5 | 14.0 | 5.5 | 0.0 | 0.0 | 1.33 | 250 | 0.14 | Good | Good |
| | 30 | 68.5 | 0.0 | 10.0 | 14.0 | 7.5 | 0.0 | 0.0 | 1.40 | | 0.18 | Good | Good |
| | 31 | 65.0 | 0.0 | 10.0 | 22.5 | 2.5 | 0.0 | 0.0 | 2.25 | | 0.16 | Good | Good |
| | 32 | 73.5 | 0.0 | 11.0 | 15.0 | 0.0 | 0.5 | 0.0 | 1.36 | | 0.44 | Good | Good |
| | 33 | 68.5 | 0.0 | 10.0 | 14.0 | 0.0 | 7.5 | 0.0 | 1.40 | | 0.27 | Good | Good |
| | 34 | 60.0 | 0.0 | 25.0 | 12.0 | 0.0 | 3.0 | 0.0 | 0.48 | | 0.40 | Good | Good |
| | 35 | 73.5 | 0.0 | 11.0 | 15.0 | 0.0 | 0.0 | 0.5 | 1.36 | | 0.51 | Good | Good |
| | 36 | 70.0 | 0.0 | 10.5 | 14.5 | 2.0 | 3.0 | 0.0 | 1.38 | | 0.21 | Good | Good |
| | 37 | 70.0 | 0.0 | 10.5 | 14.0 | 0.0 | 5.0 | 0.5 | 1.33 | | 0.23 | Good | Good |
| | 38 | 70.0 | 0.0 | 10.5 | 14.5 | 3.0 | 1.5 | 0.5 | 1.38 | | 0.18 | Good | Good |
| | 39 | 47.0 | 0.0 | 12.5 | 40.0 | 0.5 | 0.0 | 0.0 | 3.20 | | 0.48 | Good | Good |
| | 40 | 47.0 | 0.0 | 17.5 | 30.0 | 0.0 | 5.5 | 0.0 | 1.71 | | 0.36 | Good | Good |
| | 41 | 40.0 | 0.0 | 10.0 | 44.0 | 5.0 | 1.0 | 0.0 | 4.40 | | 0.29 | Good | Good |
| | 42 | 40.0 | 0.0 | 20.0 | 34.0 | 2.0 | 3.5 | 0.5 | 1.70 | | 0.37 | Good | Good |
| Comparative examples | 43 | 50.5 | 19.5 | 10.5 | 14.0 | 5.5 | 0.0 | 0.0 | 1.33 | | 0.62 | Not good | Bad |
| | 44 | 72.0 | 0.0 | 12.0 | 12.0 | 4.0 | 0.0 | 0.0 | 1.00 | | 0.63 | Not good | Bad |
| | 45 | 72.0 | 0.0 | 2.0 | 25.0 | 1.0 | 0.0 | 0.0 | 12.50 | | 0.61 | Not good | Bad |
| | 46 | 52.5 | 0.0 | 40.0 | 5.0 | 2.5 | 0.0 | 0.0 | 0.13 | | 0.88 | Not good | Bad |
| | 47 | 65.0 | 0.0 | 7.5 | 15.0 | 12.5 | 0.0 | 0.0 | 2.00 | | 0.66 | Not good | Bad |
| | 48 | 65.0 | 0.0 | 20.0 | 5.0 | 7.5 | 2.0 | 0.5 | 0.25 | | 0.72 | Not good | Bad |
| | 49 | 45.0 | 0.0 | 30.0 | 23.0 | 2.0 | 0.0 | 0.0 | 0.77 | | 0.83 | Not good | Bad |
| | 50 | 32.5 | 0.0 | 14.5 | 40.0 | 5.0 | 7.5 | 0.5 | 2.76 | | 0.77 | Not good | Bad |

As indicated in No. 29 through No. 42 in Table 5, the sample materials after plating of examples of the present invention, which were subjected to flux treatment using flux having the compositions falling within the range of the present invention, were evaluated to have good appearances. In addition, the sample materials No. 29 through No. 42 had the average Cl intensity of 0.6 kcps or less, and thus the evaluation for remaining flux was also Good. It can be seen that the average Cl intensity can be further lowered than that of the examples No. 1 through No. 15 of the present invention by adding various auxiliary chlorides.

In contrast, in the comparative examples No. 43 and No. 45 through No. 50 in which the flux compositions fell outside the range of the present invention, the evaluations for remaining flux were all Bad, and the appearance evaluations were also Not Good, even though various auxiliary chlorides were added thereto.

Example 2

As with Example 1 above, a steel sheet indicated in Table 1 was cut in a size of 200 mm×60 mm, and thus a sample material was obtained.

With respect to the sample material, degreasing was carried out using a commercially available alkaline degreasing agent, and then pickling was carried out with a 10% HCl aqueous solution at 60° C. until an oxide coating was taken off. After that, the sample material was subjected to flux treatment.

The flux treatment was carried out by immersing the pickled sample material for 1 minute in each of flux aqueous solutions (flux concentration: 150 to 750 g/L; temperature: 60° C.) which had been obtained by dissolving flux having the composition indicated in Table 6 in water, and in which pH was adjusted to 2 or less by adding an appropriate amount of HCl. Next, the sample material was kept in an oven heated to 170° C. for 3 minutes to completely evaporate water, and was then subjected to plating.

TABLE 6

| | Flux composition (mass %) | | | | | | | |
|---|---|---|---|---|---|---|---|---|
| Flux | $ZnCl_2$ | $NH_4Cl$ | NaCl | KCl | $SnCl_2$ | $PbCl_2$ | $BiCl_3$ | NaF |
| I | 70.0 | 0.0 | 10.5 | 14.0 | 5.5 | 0.0 | 0.0 | 0.0 |
| II | 72.0 | 28.0 | 0.0 | 0.0 | 0.0 | 0.0 | 0.0 | 0.0 |

The sample materials subjected to the flux treatment were plated by being immersed, for 100 to 300 seconds, in hot dip Zn—Al—Mg plating baths which had various compositions. The sample materials after plating were cooled to 50° C. by air cooling.

The evaluation was carried out in a manner similar to that of Example 1, and the results are indicated in Table 7.

TABLE 7

| Class | No | Flux | Flux Concentration (g/L) | Plating bath composition (mass %) Al | Mg | Si | Ti | B | Zn | Bath temperature (° C.) | Immersion time (s) | Average Cl intensity (kcps) | Appearance evaluation | Remaining flux evaluation |
|---|---|---|---|---|---|---|---|---|---|---|---|---|---|---|
| Examples of present invention | 51 | I | 150 | 0.5 | 0.5 | 0.004 | 0.00 | 0.000 | bal. | 440 | 100 | 0.21 | Good | Good |
| | 52 | | 250 | 1.0 | 1.0 | 0.040 | 0.00 | 0.000 | bal. | 440 | 100 | 0.30 | Good | Good |
| | 53 | | 250 | 1.0 | 3.0 | 0.040 | 0.02 | 0.005 | bal. | 450 | 200 | 0.18 | Good | Good |
| | 54 | | 250 | 1.5 | 1.5 | 0.004 | 0.01 | 0.003 | bal. | 450 | 300 | 0.32 | Good | Good |
| | 55 | | 500 | 2.5 | 1.5 | 0.040 | 0.00 | 0.000 | bal. | 450 | 100 | 0.27 | Good | Good |
| | 56 | | 250 | 3.0 | 3.0 | 0.040 | 0.02 | 0.005 | bal. | 450 | 100 | 0.17 | Good | Good |
| | 57 | | 150 | 6.0 | 3.0 | 0.004 | 0.00 | 0.000 | bal. | 450 | 100 | 0.14 | Good | Good |
| | 58 | | 250 | 6.0 | 5.0 | 0.040 | 0.02 | 0.005 | bal. | 450 | 100 | 0.12 | Good | Good |
| | 59 | | 500 | 11.0 | 3.0 | 0.200 | 0.00 | 0.000 | bal. | 500 | 100 | 0.10 | Good | Good |
| | 60 | | 750 | 15.0 | 6.0 | 0.200 | 0.01 | 0.003 | bal. | 500 | 200 | 0.11 | Good | Good |
| Comparative examples | 61 | II | 150 | 0.5 | 0.5 | 0.004 | 0.00 | 0.000 | bal. | 440 | 100 | 1.72 | Bad | Bad |
| | 62 | | 250 | 1.0 | 1.0 | 0.040 | 0.00 | 0.000 | bal. | 440 | 100 | 3.26 | Bad | Bad |
| | 63 | | 250 | 1.0 | 3.0 | 0.040 | 0.02 | 0.005 | bal. | 450 | 200 | 6.85 | Bad | Bad |
| | 64 | | 250 | 1.5 | 1.5 | 0.004 | 0.01 | 0.003 | bal. | 450 | 300 | 4.38 | Bad | Bad |
| | 65 | | 500 | 2.5 | 1.5 | 0.040 | 0.00 | 0.000 | bal. | 450 | 100 | 6.76 | Bad | Bad |
| | 66 | | 250 | 3.0 | 3.0 | 0.040 | 0.02 | 0.005 | bal. | 450 | 100 | 6.08 | Bad | Bad |
| | 67 | | 150 | 6.0 | 3.0 | 0.004 | 0.00 | 0.000 | bal. | 450 | 100 | 5.39 | Bad | Bad |
| | 68 | | 250 | 6.0 | 5.0 | 0.040 | 0.02 | 0.005 | bal. | 450 | 100 | 6.62 | Bad | Bad |
| | 69 | | 500 | 11.0 | 3.0 | 0.200 | 0.00 | 0.000 | bal. | 500 | 100 | 7.02 | Bad | Bad |
| | 70 | | 750 | 15.0 | 6.0 | 0.200 | 0.01 | 0.003 | bal. | 500 | 200 | 8.11 | Bad | Bad |

As indicated in No. 51 through No. 60 in Table 7, the sample materials after plating of examples of the present invention, which were subjected to flux treatment using flux having the compositions falling within the range of the present invention, were evaluated to have good appearances. In addition, the sample materials No. 51 through No. 60 had the average Cl intensity of 0.6 kcps or less, and thus the evaluation for remaining flux was also Good.

In contrast, in the comparative examples No. 61 through No. 70 in which the flux treatment was carried out using flux having a general composition constituted by $ZnCl_2$ and $NH_4Cl$, the evaluations for remaining flux were all Bad, and the appearance evaluations were also Bad.

REFERENCE SIGNS LIST

1: Steel product (material to be plated)

3: Hot dip Zn—Al—Mg-based alloy coated steel product

11: Flux (flux for hot dip Zn—Al—Mg-based alloy plating)

The invention claimed is:

1. A flux for hot dip Zn—Al—Mg-based alloy plating, comprising:

$ZnCl_2$; and a low-reactive chloride having lower reactivity with Mg in a plating bath than the $ZnCl_2$, the low-reactive chloride containing at least two chlorides selected from the compound group consisting of alkali metal chlorides and alkaline-earth metal chlorides, the low-reactive chloride being a chloride having free energy of formation that is lower than that of $MgCl_2$, said flux being in a pellet form and substantially not containing $NH_4Cl$ and substantially not containing NaF, a composition of the $ZnCl_2$ and the low-reactive chloride being adjusted so that a liquidus temperature of said flux is 450° C. or lower even in a case where all of the $ZnCl_2$ contained in said flux has been substituted by $MgCl_2$, the low-reactive chloride containing NaCl, and KCl, the flux containing an auxiliary chloride in an amount of more than 0% by mass and not more than 7.5% by mass in total, the auxiliary chloride including at least one chloride among a chloride of Sn, a chloride of Pb, and a chloride of Bi, and where a total mass of (i) the $ZnCl_2$ and (ii) the low-reactive chloride is assumed to be 100 parts by mass, a contained amount of $ZnCl_2$ being not less than 52.5% by mass and not more than 74.1% by mass, a total contained amount of the NaCl and KCl being not less than 25.9% by mass and not more than 47.5% by mass, and a ratio of a mass of KCl to a mass of NaCl (KCl/NaCl) being 0.15 or more and 11.5 or less.

2. The flux as set forth in claim 1, wherein a total contained amount of the auxiliary chloride is not less than 0.5% by mass and not more than 7.5% by mass.

3. A method for producing a hot dip Zn—Al—Mg-based alloy coated steel product, said method comprising:

a flux treatment step of immersing a material to be plated in a flux bath in which flux for hot dip Zn—Al—Mg-based alloy plating recited in claim 1 is dissolved in water; and a plating step of immersing the material to be plated, which has been subjected to the flux treatment, in a hot dip Zn—Al—Mg-based alloy plating bath.

4. The method as set forth in claim 3, wherein:

in the plating step, the material to be plated at a temperature of lower than 300° C. is immersed in the hot dip Zn—Al—Mg-based alloy plating bath.

5. A flux for hot dip Zn—Al—Mg-based alloy plating, comprising:

$ZnCl_2$; and a low-reactive chloride having lower reactivity with Mg in a plating bath than the $ZnCl_2$, the low-reactive chloride containing at least two chlorides selected from the compound group consisting of alkali metal chlorides and alkaline-earth metal chlorides, the low-reactive chloride being a chloride having free energy of formation that is lower than that of $MgCl_2$, the flux being in a pellet form and substantially not containing $NH_4Cl$ and substantially not containing NaF, and a composition of the $ZnCl_2$ and the low-reactive chloride being adjusted so that a liquidus temperature of said flux is 450° C. or lower even in a case where all of the $ZnCl_2$ contained in said flux has been substituted by $MgCl_2$, wherein:

the low-reactive chloride contains NaCl and KCl;

a contained amount of the $ZnCl_2$ is not less than 40.0% by mass and less than 52.5% by mass, and a total contained amount of the low-reactive chloride is more than 47.5% by mass and not more than 60.0% by mass; and a ratio (KCl/NaCl) of a mass of the KCl to a mass of the NaCl is 1.25 or more.

6. The flux as set forth in claim 5, further comprising an auxiliary chloride which includes at least one chloride among a chloride of Sn, a chloride of Pb, and a chloride of Bi, a total contained amount of the auxiliary chloride being more than 0% by mass and less than 10.0% by mass.

7. A method for producing a hot dip Zn—Al—Mg-based alloy coated steel product, said method comprising:

a flux treatment step of immersing a material to be plated in a flux bath in which flux for hot dip Zn—Al—Mg-based alloy plating recited in claim 5 is dissolved in water; and a plating step of immersing the material to be plated, which has been subjected to the flux treatment, in a hot dip Zn—Al—Mg-based alloy plating bath.

* * * * *